US005938243A

United States Patent [19]

De Santo

[11] Patent Number: 5,938,243

[45] Date of Patent: Aug. 17, 1999

[54] PAPER PRODUCT AND RELATED METHOD

[76] Inventor: Ronald F. De Santo, 8960 W. 99th Pl., Palos Hills, Ill. 60465

[21] Appl. No.: 08/978,714

[22] Filed: Nov. 26, 1997

Related U.S. Application Data

[62] Division of application No. 08/636,528, Apr. 23, 1996, Pat. No. 5,769,773.

[51] Int. Cl.[6] ..... B42D 15/04

[52] U.S. Cl. ..... 283/56; 283/61; 283/62; 283/63.1; 283/34; 462/26; 493/187; 493/188; 493/193; 493/235; 53/389.2; 53/389.3

[58] Field of Search ..... 283/56, 61, 62, 283/63.1, 34; 462/26; 493/187, 188, 193, 235; 53/389.3, 389.2

[56] References Cited

U.S. PATENT DOCUMENTS 5,346,455 9/1994 Volkert ..... 156/269
5,389,174 2/1995 Hibsch et al. ..... 283/56

FOREIGN PATENT DOCUMENTS 2193155 2/1988 United Kingdom ..... 283/56

*Primary Examiner*—Willmon Fridie, Jr.
*Assistant Examiner*—Mark T. Henderson
*Attorney, Agent, or Firm*—Trexler, Bushnell, Giangiorgi & Blackstone, Ltd.

[57] ABSTRACT

A paper product, such as an advertising brochure, a cover or the like, is formed by using the novel method of the present invention. In the present method, a continuous moving web of paper is provided. The web is longitudinally slit at positions offset to one side of a longitudinal axis of the web, preferably a centerline axis, at spaced positions to form a plurality of longitudinal slits which are separated from each other by a continuous portion of the web. Thereafter, adhesive is deposited on the web at a position offset from the longitudinal slit, and preferably along a side margin of the web. A first portion of the web is folded over onto a second portion of the web along a fold line at a position between the longitudinal slit and the adhesive. Next, the first portion is secured to the second portion by the adhesive to form a secured section. The longitudinal slit is thereafter positioned between the secured section and the fold line. Alternatively, the folding step can be replaced by transversely slitting the web and gluing the first portion to the second portion at the point where the fold line would have occurred. The web is then transversely chopped to sever the continuous portions of the web between the longitudinal slits. Alternatively, the web can be reeled up and collected in a roll and later chopped by an end user.

3 Claims, 3 Drawing Sheets

PAPER PRODUCT AND RELATED METHOD

This is a divisional application of application Ser. No. 08/636,528 filed on Apr. 23, 1996, now U.S. Pat. No. 5,769,773.

BACKGROUND OF THE INVENTION

This invention is generally directed to a novel method for forming a paper product, such as an advertising brochure, a cover or the like, and to the product itself, which is commonly referred to in the industry as a "double gatefold". More particularly, the invention contemplates a paper product having perfect registration between front flaps formed by the novel method disclosed herein.

Conventionally, a "double gatefold" is a paper product which is formed by feeding a continuous roll of paper, referred to as a "web", through "in-line finishing" equipment which includes gate folders which fold each side marginal portion of the web towards the middle, i.e., a double gatefold. The final step required to produce the individual paper products is to transversely cut the web of gatefolded paper into the individual paper products which were contained in the web, one after another.

The folding steps form flaps, the inner edges of which are supposed to be near perfectly adjacent to each other when the folding steps are completed. It has been found, however, that when using the conventional folding method, perfect registration between the inner edges of the flaps is hard to achieve. Often times, the flap edges overlap each other, or a gap is formed between the flap edges. This, of course, causes problems with legibility of advertising copy which may be printed across the adjacent flaps and otherwise creates a non-commercially attractive product.

The novel method of the present invention presents a series of steps which results in a product of the type referred to as a "double gatefold", but one which has perfect registration between the flap edges. Other features and advantages will become apparent upon a reading of the attached specification and upon viewing the accompanying drawings.

OBJECTS AND SUMMARY OF THE INVENTION

A general object of the present invention is to provide a novel method for forming a "double gatefold" paper product which achieves perfect registration of adjacent flap portions.

Another general object of the present invention is to provide a paper product formed in accordance with the novel method of the present invention.

Briefly, and in accordance with the foregoing, the present invention discloses a novel method of forming a paper product, such as an advertising brochure, a cover or the like. In the present method, a continuous moving web of paper is provided. The web is longitudinally slit at positions offset to one side of a longitudinal axis of the web, such as a centerline axis, at spaced positions to form a plurality of longitudinal slits which are separated from each other by a continuous portion of the web. Accordingly, the longitudinal slits formed are non-continuous along the length of the web. Thereafter, adhesive is deposited on the web at a position offset from the longitudinal slits, and preferably along or near a side margin of the web. A first portion of the web is folded over onto a second portion of the web along a fold line located at a position between the longitudinal slits and the adhesive. Next, the first portion is secured to the second portion by the adhesive to form a secured section. The longitudinal slits are thereafter positioned between the secured section and the fold line. The web is then transversely chopped to sever and remove the continuous portions of the web between the longitudinal slits. Alternatively, the web can be reeled up and collected in a roll and chopped by an end user, such as a bindery.

In addition, prior to the step of folding the first portion onto the second portion of said web, a step of providing patches of glue on the web at positions offset from the longitudinal slits can be provided such that when the flap portions are subsequently formed, respective glue patches are sandwiched between each flap portion and the first portion. The glue is, preferably, but not necessarily, a releasable adhesive which allows a user to selectively separate the flap portions from the first portion and to re-adhere the flap portions to the first portion.

Modifications, which would be obvious to one of ordinary skill in the art, can be incorporated into the above-described method. For example, instead of folding the first portion of the web over onto the second portion of the web, the web can be longitudinally slit, by a die cutter, along the length of the web between the line of adhesive and the spaced slits to completely separate the first portion from the second portion thereby forming two separate ribbons. Thereafter, the first portion is positioned over on top of the second portion such that the first portion overlaps at least a portion of the second portion. If this process is used, the web is slit at the same location where the fold would have taken place. In addition, a second line of adhesive is deposited on the portion of the web on which the other line of adhesive has been deposited, such that when the first portion is placed over the second portion, the first and second portions are secured together along the length of each adhesive line to form a pair of secured sections. The longitudinal slits are thereafter positioned between the secured sections. The web is then transversely chopped to sever and remove the continuous portions of the web between the longitudinal slits. Alternatively, the web can be reeled up and collected in a roll and chopped by an end user.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements in which.

DETAILED DESCRIPTION OF THE ILLUSTRATED EMBODIMENTS

Figure 2:
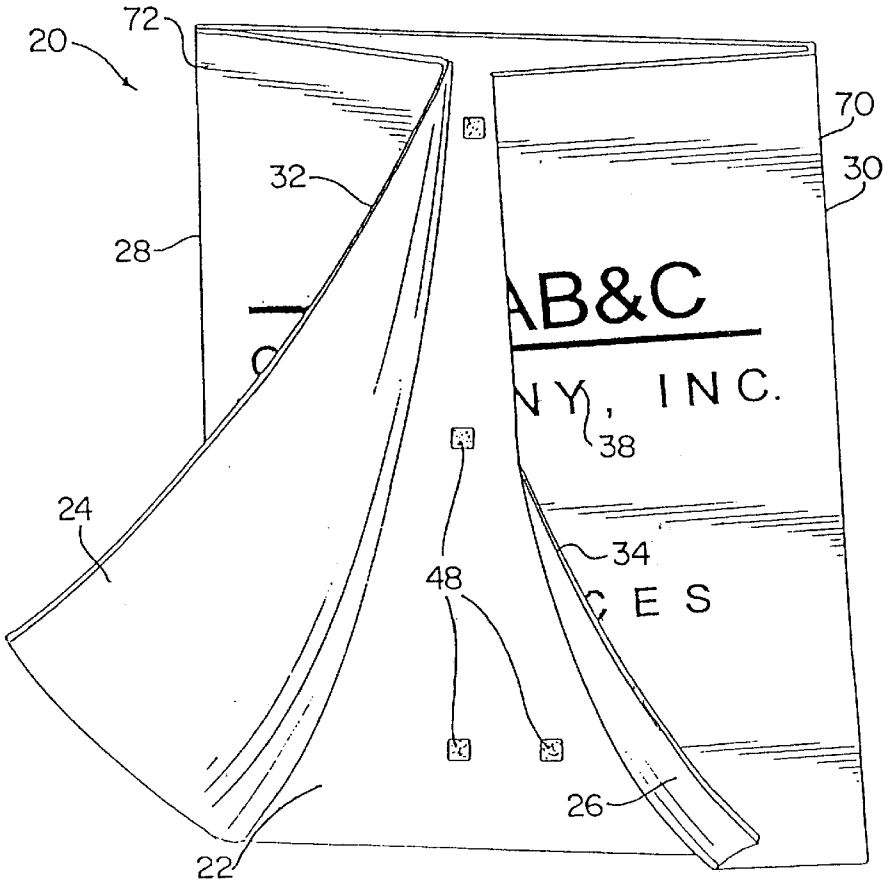
FIG. 2 is a front elevational view of the paper product shown in FIG. 1 with the flap portions of the product shown in a partially open position.

While the invention may be susceptible to embodiment in different forms, there is shown in the drawings, and herein will be described in detail, specific embodiments with the understanding that the present disclosure is to be considered an exemplification of the principles of the invention, and is not intended to limit the invention to that as illustrated and described herein.

Figure 1:
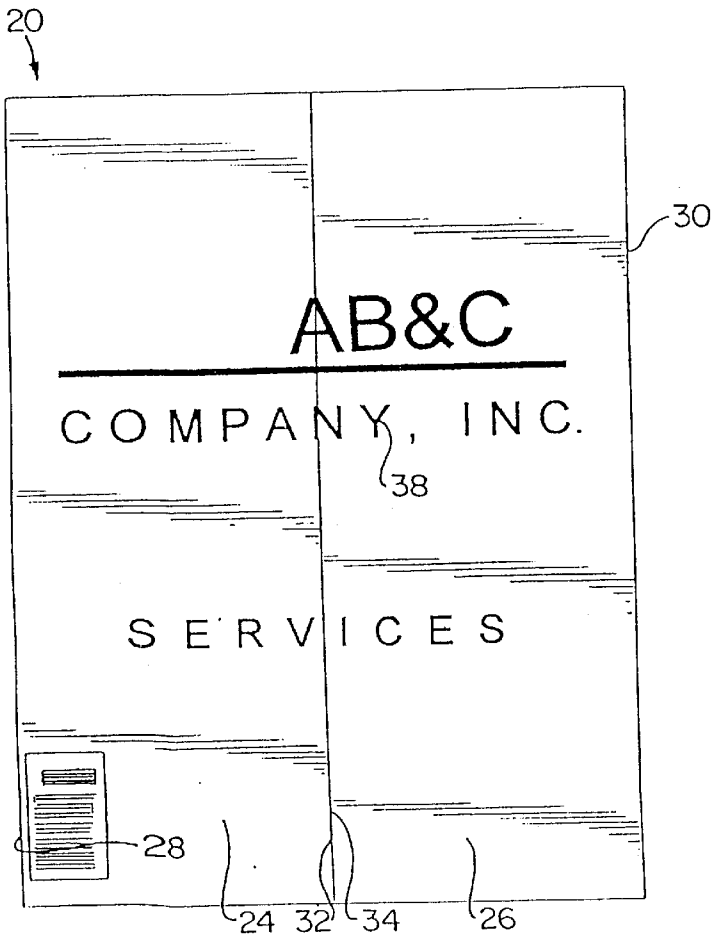
FIG. 1 is a front elevational view of a paper product which is formed in accordance with the features of the invention.
Figure 3A:
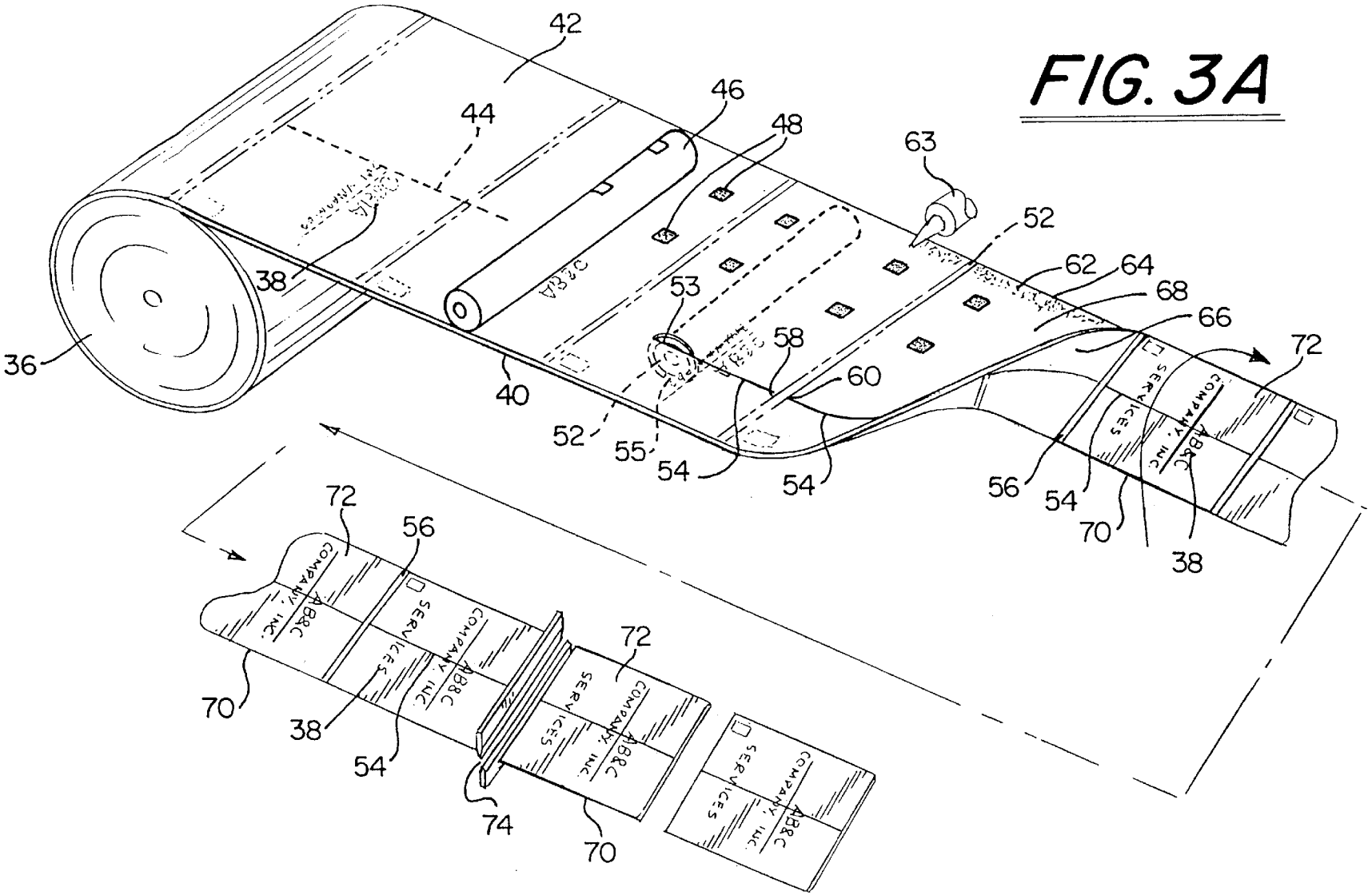
FIG. 3A is a schematic view of the novel method, wherein the web of paper is separated into individual paper products by a transverse cutter.
Figure 3B:
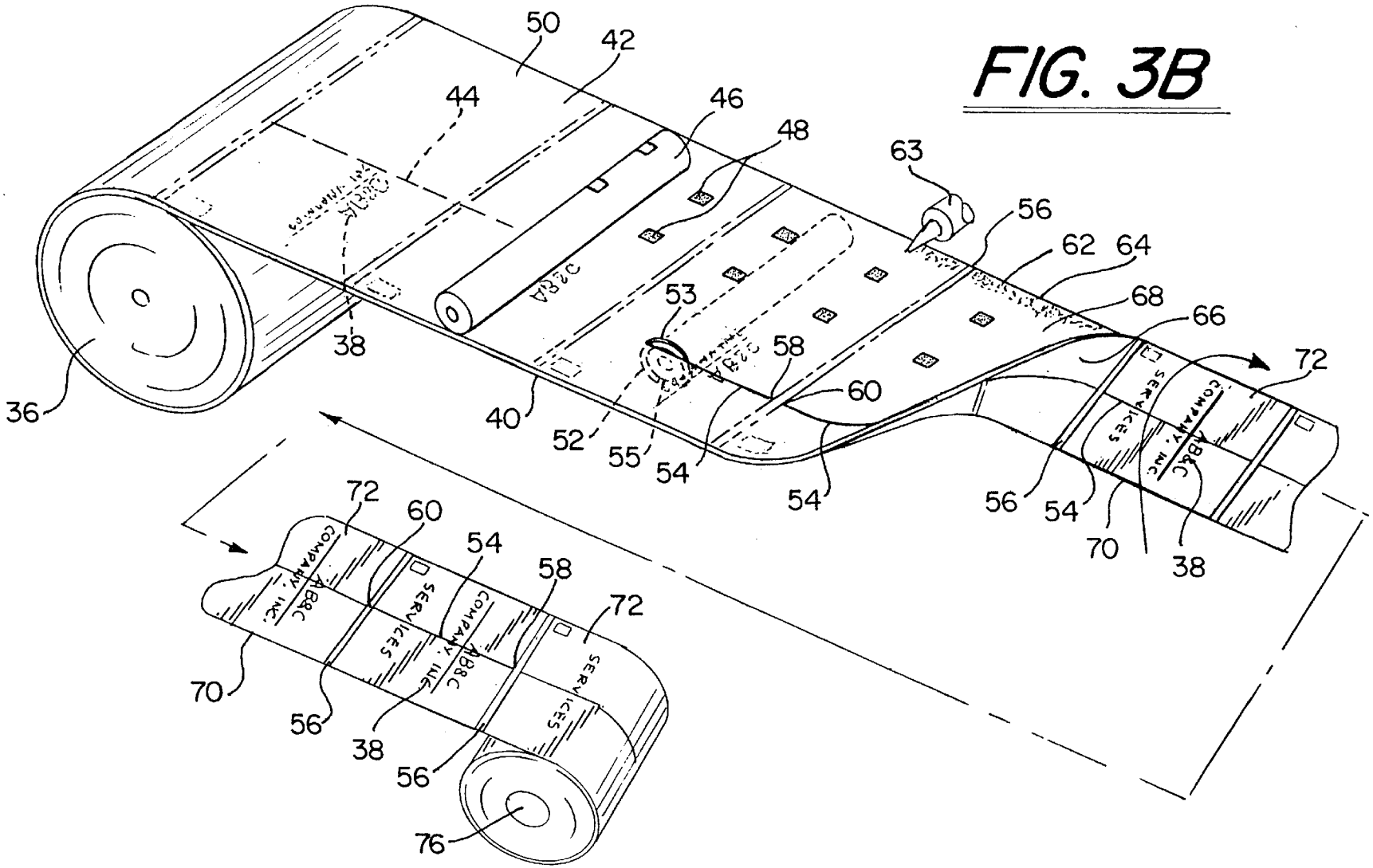
FIG. 3B is a schematic view of the method, wherein the web of paper is thereafter reeled up to form a roll.

A paper product 20, as shown in FIGS. 1 and 2, is formed in accordance with the novel method schematically illustrated in FIG. 3A. FIG. 3B illustrates the novel method of "in-line finishing" without thereafter separating the web of paper into individual paper products, like that shown in FIGS. 1 and 2. The paper product 20 can be used as an advertising brochure, a cover, an insert to a magazine or a book, or the like.

For convenience in the description of the paper product 20 and the novel method herein, terminology, such as top, bottom and the like, is used. This terminology is for convenience only and is not intended to limit the invention to these specific orientations.

The paper product 20 in its final form, when formed in accordance with the method described hereinbelow, includes a base portion 22, a first flap portion 24 and a second flap portion 26. The first and second flap portions 24, 26 are connected to the base portion 22 at their respective outer edges 28, 30, respectively, as described herein, and lie adjacent to each other at their inner edges 32, 34, respectively, as described herein, to achieve near perfect "registration" between the inner edges 32, 34 of the flap portions 24, 26, such that the inner edges 32, 34 do not overlap each other and are not noticeably spaced apart from each other. Thus, any graphics, such as advertising copy, printed on the flap portions 24, 26 is perfectly aligned.

The novel method of the present invention employs die-cutting, positioning and bonding steps. By using the novel method of the present invention, near perfect registration is achieved between the flap portions 24, 26.

In the method of the present invention, a roll of paper 36, which usually has graphics 38, such as print, images or the like, provided on at least a bottom surface 40 thereof, is provided. The roll 36 dispenses a continuous web of paper 42 therefrom on which the following steps are performed to form the paper product 20. The continuous web of paper 42 travels in the form of a flat sheet. A longitudinal axis 44 is defined along the length of the web 42 and is preferably, but not necessarily, a longitudinal centerline of the web 42. The graphics 38, only for purposes of discussion herein, is printed on one side of the longitudinal axis 44 and only on the bottom surface 40 of the web 42. It is to be understood, however, that graphics 38 may be provided along the entire underside and topside of the web 42 if desired, and as is usually the case.

The first operation performed to the web 42 is that a pattern glue roller 46 deposits glue patches 48 on an top surface 50 of the web 42 at predetermined, spaced locations and on the opposite side of the longitudinal axis 44 to that which the graphics 38 is printed. The glue patches 48 deposited on the web 42 are preferably, but not necessarily, formed from a releasable glue to which a piece of paper can be adhered to and released from, repeatedly. Pattern glue rollers are conventional, and as such, the details of the roller 46 are omitted.

Next, the flat traveling web 42 is diecut by a diecut roller 52 to form a plurality of longitudinal, spaced slits 54 along the length of the web 42. The diecut roller 52 includes a blade 53 which extends around the circumference of the roller 52 with the exception of a non-continuous portion 55 of the blade 53. The non-continuous portion 55 does not cut into the web 42 as it passes thereover. Therefore, when the web 42 passes over the diecut roller 52, the longitudinal, spaced slits 54 are formed non-continuously along the length of the web 42. Each slit 54 is separated from each other by a non-slit or continuous portion 56 of the web 42 at both a leading edge 58, and a trailing edge 60 of each slit 54 provided by the non-continuous portion 55 of the blade 53. The web 42 is slit for predetermined, non-continuous, lengths at positions that are offset from the longitudinal axis 44 and are on the side of the longitudinal axis 44 that is the same as the side on which the graphics 38 is printed. For example, each slit 52 can be approximately 11" in length, and separated from another by the continuous portion 56 of the web 42 which is approximately 1" in length. Therefore, after the completion of the diecut slitting step, the web 42 is still travelling as a flat sheet, but now has intermittent slits 54 along its length at predetermined locations on the web 42 separated by continuous portions 56 of the web 42. The slits 54 are preferably straight, but may take some other form, such as an arc, if desired.

The next step in the novel method of the present invention comprises laying down a line of adhesive 62 on the top surface 50 of the moving web 42 and at a position which is remote or spaced from the line of intermittent slits 54 by using a suitable gluing apparatus 63. Preferably, but not necessarily, the line of adhesive 62 is deposited along or near to a side edge 64 of the moving web 42 which is furthest away from that which the graphics 38 is printed on in the illustrated example. The line of adhesive 62 is preferably laid down on the top surface 50 of the web 42 continuously, however, the adhesive can be laid down intermittently such that adhesive is not provided along the portions of the traveling web 42 adjacent to where the continuous portions 56 between the slits 54 are provided.

Thereafter, a first portion 66 of the web 42 is folded over onto a second portion 68 of the web 42 along a fold line 70, which may correspond to the longitudinal axis 44, by using suitable means, such as a standard plow folder or gate folder (not shown), so as to position the first portion 66 on top of the second portion 68. When the first portion 66 is folded over onto the second portion 68, the graphics 38 is visible from an above view and the glue patches 48 previously deposited on the top side of the moving web 42 are sandwiched between the first portion 66 and the second portion 68. In addition, the first portion 66 has the elongated, spaced slits 54 thereon and the second portion has the line of adhesive 62 thereon. Of course, the second portion 68 could be folded over onto the first portion 66. The section of the first portion 66 which overlays the line of adhesive 62 on the second portion 68 is secured to the second portion 68 by suitable means, such as by pressure from a suitable source, to form a secured section 72.

Preferably, because the line of adhesive 62 is deposited adjacent to the side edge 64 of the web 42, the web 42 is preferably folded along the longitudinal centerline of the web 42, such centerline being spaced equidistant from the side edges of the web 42, such that the web 42 is folded in half. In addition, preferably the slits 54 are provided along one-quarter of the width of the web 42 such that when the web 42 is folded in half, the slits 54 are in the center of the folded-over first portion 66. These precise locations are not essential and are only preferred. For example, the web 42 could be folded along a longitudinal axis 44 which is defined at a position which is one-quarter of the width of the web 42 and the slits 54 can be provided at a position which is one-eighth of the width of the web 42. In this situation, the first portion 66 would be much shorter in width than the second portion 68 such that a portion of the second portion 69 is not completely overlapped by the first portion 66 when the fold takes place.

After the gate folding step, the method of producing the paper product 20 is complete, but for the separation of the web 42 into individual paper products, which is accomplished by transversely chopping the moving web 42 with a cutter 74, such as a rotary cutter or a pair of blades, as shown in FIG. 3A. The chopping operation occurs at the continuous portions 56 between the slits 54 in the web 42 to completely remove the continuous portions 56 of the web 42 from the remainder of the web 42, and thereby not only separates the paper products into individual pieces, but releases the flap portions 24, 26, which are formed by the sections of the first portion 66 on the opposite sides of the slit 54, so that the flap portions 24, 26 can now be turned-open towards the side edges of the paper product 20. Depending on the length of the continuous portions 56 of the web 42, the trimmed-away sections can be of various dimensions.

As discussed herein, the glue patches 48 are sandwiched between the first portion 66 and the second portion 68 after the web 42 is folded. Specifically, the glue patches 48 are provided such that a pair of patches are between the flap portion 24 and the second or base portion 22 and another pair of patches are between the flap portion 26 and the second or base portion 22. After the continuous portions 56 of the web 42 have been chopped away by the cutter 74, the glue patches 48 prevent the flap portions 24, 26 from freely opening. If desired, the glue patches 48 can be eliminated from the design.

Alternatively, the folded web 42 can be reeled up and collected on a take-up roller 76 as shown in FIG. 3B thereby eliminating the step of chopping the web 42 into individual paper products. The step of transversely chopping the web 42 is then performed by a bindery or other user, in order to separate the web 42 into individual paper products.

Modifications, which would be obvious to one of ordinary skill in the art, can be incorporated into the above-described method. For example, instead of folding the first portion 66 of the web 42 over onto the second portion 68 of the web 42, the web 42 can be longitudinally slit, by a conventional die cutter (not shown), along the length of the web 42 between the line of adhesive 62 and the spaced slits 54 to completely separate the first portion 66 from the second portion 68 thereby forming two separate ribbons. Thereafter, the first portion 66 is positioned over on top of the-second portion 68 such that the first portion 66 overlaps at least a portion of the second portion 68. If this process is used, the web 42 is slit at the same location where the fold, i.e. along fold line 70, would have taken place. In addition, a second line of adhesive (not shown) is deposited on the second portion 68 at a positioned spaced from the line of adhesive 62, and preferably, but not necessarily, proximate to the opposite side margin of the second portion 68, such that when the first portion 66 is placed over the second portion 68, the first and second portions 66, 68 are secured together along the length of each adhesive line to form a pair of secured sections. The longitudinal, intermittent slits 54 are thereafter positioned between the secured sections. The web 42 is then transversely chopped to sever and remove the continuous portions 56 of the web 42 between the longitudinal slits as described hereinabove. Alternatively, the web 42 can then be reeled up and collected in a roll as described hereinabove.

The unique result of this novel method of creating the paper product 20 is that perfect registration between the inner edges 32, 34 of the flap portions 24, 26 is achieved which is very difficult, if not impossible, to achieve by the conventional double gatefolding method. The result is a much more attractive, higher-quality appearance for an advertising presentation.

While a specific order of steps is presented herein, it is to be understood that some of the steps can be taken after others. Additionally, other steps may be performed on the moving web 42 than those shown in the drawings. For example, a printing step could be performed on the web 42 prior to the die cutting step.

While the novel method described hereinabove is described with respect to a continuous moving web of paper 42, the same method can be performed on a single sheet of paper or a line of single sheets of paper. When the sheet of paper is diecut by the diecut roller 52, a head margin, which is proximate to the top edge of the sheet, and a foot margin, which is proximate to the bottom edge of the sheet, are not slit by the diecut roller 52. Each unslit head margin of the sheet corresponds to approximately half of one of the continuous portions 56 of the web 42 and each unslit foot margin of the sheet corresponds to the other half of the continuous portion 56. The cutter 74 is used to sever the unslit head and foot margins away from the remainder of the sheet to free the flap portions 24, 26. This step corresponds to the step of cutting the continuous portions 56 away from the remainder of the paper product 20 in the method described herein.

Additional panels could be included in the design so that the paper product 20 could be used for front covers, back covers and inserts.

While preferred embodiments of the present invention are shown and described, it is envisioned that those skilled in the art may devise various modifications of the present invention without departing from the spirit and scope of the appended claims.

The invention claimed is:

1. A continuous web of advertising brochures each comprising: a base portion having opposite side margins, a top margin and a bottom margin; a first flap portion connected to one of said side margins and a second flap portion connected to the other of said side margins of said base portion, said first and second flap portions overlying said base portion and being separated from each other by a longitudinal slit extending from the top margin of the base portion to the bottom margin of the base portion; said continuous web of advertising brochures further comprising end portions separating the individual advertising brochures from one another along said continuous web.

2. A continuous web of advertising brochures as defined in claim 1, wherein said end portions are cut away from said continuous web of advertising brochures.

3. A continuous web of advertising brochures as recited in claim 1, wherein the web is reeled into a transportable roll such that the individual brochures can be separated from one another at another location.

* * * * *